US008965016B1

(12) United States Patent
Howes

(10) Patent No.: US 8,965,016 B1
(45) Date of Patent: Feb. 24, 2015

(54) AUTOMATIC HEARING AID ADAPTATION OVER TIME VIA MOBILE APPLICATION

(71) Applicant: Christopher Larry Howes, Eden Prairie, MN (US)

(72) Inventor: Christopher Larry Howes, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/958,212

(22) Filed: Aug. 2, 2013

(51) Int. Cl.
*H04R 25/00* (2006.01)

(52) U.S. Cl.
CPC ..... *H04R 25/70* (2013.01); *H04R 25/554* (2013.01)
USPC ..... 381/314; 381/315

(58) Field of Classification Search
USPC ..... 381/23.1, 58, 60, 312, 314, 315
See application file for complete search history.

(56) References Cited

U.S. PATENT DOCUMENTS

| | | | |
|---|---|---|---|
| 3,527,901 | A | 9/1970 | Geib |
| 4,366,349 | A | 12/1982 | Adelman |
| 4,396,806 | A | 8/1983 | Anderson |
| 4,419,544 | A | 12/1983 | Adelman |
| 4,471,490 | A | 9/1984 | Bellafiore |
| 4,637,402 | A | 1/1987 | Adelman |
| 4,882,762 | A | 11/1989 | Waldhauer |
| 5,390,254 | A | 2/1995 | Adelman |
| 5,434,924 | A | 7/1995 | Jampolsky |
| 5,502,769 | A | 3/1996 | Gilbertson |
| 5,553,152 | A | 9/1996 | Newton |
| 5,581,747 | A | 12/1996 | Anderson |
| 5,659,621 | A | 8/1997 | Newton |
| 5,717,770 | A | 2/1998 | Weinfurtner |
| 5,757,933 | A | 5/1998 | Preves et al. |
| 5,822,442 | A | 10/1998 | Agnew et al. |
| 5,825,631 | A | 10/1998 | Prchal |
| 5,835,611 | A | 11/1998 | Kaiser et al. |

(Continued)

FOREIGN PATENT DOCUMENTS

| | | | |
|---|---|---|---|
| DE | 19542961 | C1 | 5/1997 |
| DE | 10021985 | A1 | 10/2001 |

(Continued)

OTHER PUBLICATIONS

"U.S. Appl. No. 10/997,805, Final Office Action mailed Jun. 27, 2006", 14 pgs.

(Continued)

*Primary Examiner* — Tuan D Nguyen
(74) *Attorney, Agent, or Firm* — Schwegman Lundberg & Woessner, P.A.

(57) ABSTRACT

A hearing assistance system for delivering sounds to a listener provides for programming of a hearing assistance device, such as a hearing aid, using a communication link with a secondary device such as a smartphone. An example hearing assistance system may compensate for a patient's hearing deficit in a gradually progressing fashion over a configured period of absolute time, device operation time, or a combination of absolute and operation time. The hearing assistance device may be programmed by an application operating on the secondary device to successively select a parameter set that defines an operating characteristic of the signal processing circuit from a group of such parameter sets over a period of time or in response to a listener or physician input. The physician input may be received by the secondary device over a network. The defined sequence may end in a parameter set that optimally compensates the patient's hearing.

18 Claims, 4 Drawing Sheets

(56) References Cited

U.S. PATENT DOCUMENTS

| | | | | |
|---|---|---|---|---|
| 5,838,806 | A | 11/1998 | Sigwanz et al. | |
| 5,852,668 | A | 12/1998 | Ishige et al. | |
| 5,862,238 | A | 1/1999 | Agnew et al. | |
| 6,041,129 | A | 3/2000 | Adelman | |
| 6,236,731 | B1 | 5/2001 | Brennan et al. | |
| 6,240,192 | B1 | 5/2001 | Brennan et al. | |
| 6,347,148 | B1 | 2/2002 | Brennan et al. | |
| 6,366,863 | B1 | 4/2002 | Bye et al. | |
| 6,389,142 | B1 | 5/2002 | Hagen et al. | |
| 6,449,662 | B1 | 9/2002 | Armitage | |
| 6,741,712 | B2 | 5/2004 | Bisgaard | |
| 6,829,363 | B2 | 12/2004 | Sacha | |
| 7,206,424 | B2 | 4/2007 | Sacha | |
| 8,005,232 | B2 * | 8/2011 | Roeck et al. | 381/60 |
| 8,085,961 | B2 | 12/2011 | Aschoff et al. | |
| 8,284,968 | B2 * | 10/2012 | Schumaier | 381/312 |
| 8,472,634 | B2 * | 6/2013 | Schumaier et al. | 381/60 |
| 2001/0007050 | A1 | 7/2001 | Adelman | |
| 2001/0055404 | A1 | 12/2001 | Bisgaard | |
| 2002/0071582 | A1 | 6/2002 | Troelsen et al. | |
| 2002/0076073 | A1 | 6/2002 | Taenzer et al. | |
| 2003/0215105 | A1 | 11/2003 | Sacha | |
| 2005/0254675 | A1 | 11/2005 | Sacha | |
| 2010/0076793 | A1 | 3/2010 | Goldstein et al. | |
| 2013/0101128 | A1 | 4/2013 | Lunner et al. | |

FOREIGN PATENT DOCUMENTS

| | | | |
|---|---|---|---|
| EP | 0341903 | A2 | 11/1989 |
| EP | 0964603 | A1 | 12/1999 |
| EP | 1206163 | A1 | 5/2002 |
| EP | 2280562 | A2 | 2/2011 |
| WO | WO-0021332 | A2 | 4/2000 |
| WO | WO-0126419 | A1 | 4/2001 |

OTHER PUBLICATIONS

"U.S. Appl. No. 10/997,805, Non Final Office Action mailed Dec. 14, 2005", 13 pgs.

"U.S. Appl. No. 10/997,805, Notice of Allowance mailed Dec. 20, 2006", 7 pgs.

"U.S. Appl. No. 10/997,805, Response filed Nov. 27, 2006 to Final Office Action mailed Jun. 26, 2006", 10 pgs.

"U.S. Appl. No. 10/997,805,Response filed Apr. 14, 2006 to Non Final Office Action mailed Dec. 14, 2005", 9 pgs.

"U.S. Appl. No. 10/146,986, Final Office Action mailed Feb. 23, 2004", 12 pgs.

"U.S. Appl. No. 10/146,986, Non Final Office Action mailed Oct. 6, 2003", 11 pgs.

"U.S. Appl. No. 10/146,986, Notice of Allowance mailed Jul. 30, 2004", 6 pgs.

"U.S. Appl. No. 10/146,986, Response filed Jan. 6, 2004 to Non Final Office Action mailed Oct. 6, 2003", 10 pgs.

"U.S. Appl. No. 10/146,986, Response filed Jun. 23, 2004 to Final Office Action mailed Feb. 23, 2004", 8 pgs.

"Canadian Application Serial No. 2,429,128, Office Action mailed Mar. 14, 2007", 3 pgs.

"Canadian Application Serial No. 2,429,128, Response filed Sep. 12, 2007 to Office Action mailed Mar. 14, 2007", 15 pgs.

"European Application Serial No. 03253062.8, Communication of Notice of Opposition mailed Jul. 7, 2011", 11 pgs.

"European Application Serial No. 03253062.8, Communication of Notice of Opposition mailed Aug. 5, 2011", 1 pg.

"European Application Serial No. 03253062.8, Office Action mailed Feb. 26, 2013", 5 pgs.

"European Application Serial No. 03253062.8, Response filed Feb. 15, 2012 to Office Action mailed Aug. 5, 2011", 16 pgs.

"European Application Serial No. 03253062.8, Response filed Apr. 24, 2008 to Office Action mailed Jun. 28, 2007", 16 pgs.

"European Application Serial No. 03253062.8, Search Report mailed Nov. 21, 2005", 3 pgs.

"European Application Serial No. 03253062.8, Summons to Attend Oral Proceedings mailed Jan. 9, 2013", 11 pgs.

"European Application Serial No. 03253062.8, Summons to Attend Oral Proceedings mailed Feb. 26, 2013", 5 pgs.

"European Application Serial No. 19542961, Office Action mailed Jun. 28, 2007", 4 pgs.

Griffing, Terry S, et al., "Acoustical Efficiency of Canal ITE Aids", Audecibel, (Spring 1983), 30-31.

Griffing, Terry S, et al., "Custom canal and mini in-the-ear hearing aids", Hearing Instruments, vol. 34, No. 2, (Feb. 1983), 31-32.

Griffing, Terry S, et al., "How to evaluate, sell, fit and modify canal aids", Hearing Instruments, vol. 35, No. 2, (Feb. 1984), 3 pgs.

Mahon, William J, "Hearing Aids Get a Presidential Endorsement", The Hearing Journal,, (Oct. 1983), 7-8.

Sullivan, Roy F, "Custom canal and concha hearing instruments: A real ear comparison Part I", Hearing Instruments, vol. 40, No. 4, (Jul. 1989), 23-29.

Sullivan, Roy F, "Custom canal and concha hearing instruments: A real ear comparison Part II", Hearing Instruments, vol. 40, No. 7, (Jul. 1989), 30-36.

* cited by examiner

AUTOMATIC HEARING AID ADAPTATION OVER TIME VIA MOBILE APPLICATION

FIELD OF THE INVENTION

The present subject matter relates generally to hearing assistance systems, and in particular to methods and apparatus for programming hearing assistance devices using initial settings that are adjusted to more optimal settings over a period of time.

BACKGROUND

A hearing assistance device, such as a hearing aid, may include a signal processor in communication with a microphone and receiver. Sound signals detected by the microphone and/or otherwise communicated to the hearing assistance device are processed by the signal processor to be heard by a listener. Modern hearing assistance devices may include programmable devices that have settings based on the hearing and needs of each individual listener such as a hearing aid wearer.

Wearers of hearing aids undergo a process called "fitting" to adjust the hearing aid to their particular hearing and use. In such fitting sessions a wearer may select one setting over another. Hearing aid settings may be optimized for a wearer through a process of patient interview and device adjustment. Multiple iterations of such interview and adjustment may be needed before sound quality as perceived by the wearer becomes satisfactory. This may require multiple visits to an audiologist's office. Thus, there is a need for a more efficient process for fitting the hearing aid for the wearer.

DETAILED DESCRIPTION

Figure 1:
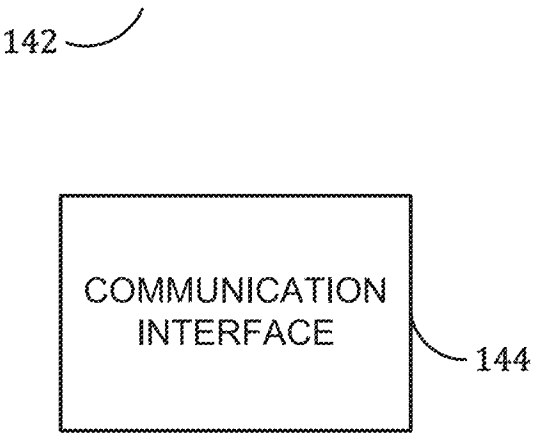
FIG. 1 is a block diagram illustrating the components of an exemplary hearing aid.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present disclosure relates to a hearing assistance system for delivering sounds to a listener provides for subjective, listener-driven programming of a hearing assistance device, such as a hearing aid, using a mobile device. Hearing assistance devices, such as hearing aids, typically include an enclosure or housing, a microphone, hearing assistance device electronics including processing electronics, and a speaker or receiver. In various designs, the speaker or receiver of a hearing assistance device is placed substantially in or near the ear canal of a wearer such that amplified sound waves may be directed towards an ear drum of the wearer. In various designs, the receiver may include a tubular structure that directs sound from the speaker to the ear drum.

Hearing professionals desire the ability to program hearing aids with less gain initially in order to let the patient adapt to wearing a hearing aid, thereby improving the experience of the patient while becoming acclimated to the hearing aid. The patient is typically instructed to come back to the professional so that the professional may manually increase the gain in steps over time. An example technique for hearing aid adjustment is discussed in U.S. Pat. No. 7,206,424, which is incorporated by reference herein in its entirety.

Generally, hearing aid fitting software may allow a hearing professional the ability to configure the desired final hearing aid settings for the patient and an initial starting point for any variety of settings (gain, compression, noise management, and any other setting a hearing professional might manipulate). The professional can also set a time frame for adaptation to occur across. The individualized settings and the time frame for adaptation may all be configured in the hearing aid firmware and read out by a specific mobile application. The mobile application may be installed on a remote mobile device, such as a smart phone or other wireless remote control device, and communicate with the hearing aid firmware via a wireless connection.

In an embodiment, the hearing assistance system includes a hearing aid device and a remote mobile device. The hearing aid device is configured to receive real time data, for example absolute time values, ambient noise values, or updated configuration data from the remote mobile device via a wireless connection. The wireless connection may be established over any appropriate wireless frequency or protocol (e.g., 2.4 GHz, 900 MHz, Wi-Fi, Bluetooth, etc.), or combination thereof. The hearing aid device may be configured to send information, for example volume settings, battery life or configuration data to the remote mobile device via the wireless connection. A user interface on the remote mobile device may display and provide a patient with information about the settings, performance, battery life or other information with respect to the hearing aid device.

In an embodiment, a hearing assistance system may combine hearing aid firmware in a hearing aid that is capable of connecting wirelessly to a mobile device, and a mobile software application on the mobile device that includes fitting or acclimation software, to create a method for the professional to prescribe starting settings and targeted settings for an initial hearing aid fitting. In an example, a real time clock in the mobile device may be utilized to coordinate automatic changes made to the hearing aid by the mobile software application. The changes to the hearing aid may be communicated over a wireless link between the mobile device and the hearing aid.

In an embodiment, a user may launch a mobile application on a remote device that is configured to communicate with a hearing aid device of the user. Upon establishing a communication session with the hearing aid device, the application may receive and store information from the hearing aid device such as the initial starting point settings, final user settings, and a time frame for adaptation configured by the hearing professional. The mobile application may utilize the information to setup automatic gradual changes to the hearing aid to move from starting to final user settings over that desired time frame. In an example, the mobile application may have advantages over the hearing aid, including the presence of a real time clock to make these adjustments over defined period of time unique to the individual. The mobile application may have an additional advantage of having access to greater computing resources (e.g., processing power or battery power) than the hearing aid, which may provide for a benefit of increasing the battery life of a battery in the hearing aid by offloading processing tasks from the hearing aid.

In an example, an automatic adaption scheme for hearing aid fittings through a system that combines fitting software in a mobile software application may also provide the professional with the ability to remotely receive notifications about the extent of the user's adaptation to the hearing aid, or to control or adjust the time frame or other settings of the hearing aid. The Professional may have the ability to provide any mix of settings for a starting point and a desired fitting point to help the patient adapt easier. This helps the patient ease into their hearing aid fitting without returning to the professional. Additional benefits include easier adaptation, earlier satisfaction, and lower return rates. The proliferation of smartphones and tablet computers across the world may also help to create a demand for the convergence of hearing aid technologies with smartphone applications.

In an embodiment, a method for fitting a hearing assistance device for a listener is provided. A plurality of presets including predetermined settings for a plurality of parameters of a signal processing algorithm may be included in a hearing aid and a hearing aid application stored on a mobile device. The hearing aid application provides for a calculation of when to transition between a pair of presets of the plurality of presets so as to improve the performance of the hearing aid as perceived by the listener. An input sound signal is processed to produce an output sound signal to be delivered to the listener by executing the signal processing algorithm at the hearing aid using the selected values of the plurality of parameters established by the hearing aid appellation on the mobile device. The mobile device may receive inputs from one or more sensors or modules (e.g., microphones, timers, clocks, GPS receivers, radio receivers, or other devices) to determine when to transition between presets.

FIG. 1 is a block diagram of the components of an exemplary hearing aid. A hearing aid is a wearable electronic device for correcting hearing loss by amplifying sound. The electronic circuitry of the device is contained within a housing that is commonly either placed in the external ear canal or behind the ear. Transducers for converting sound to an electrical signal and vice-versa may be integrated into the housing or external to it. The basic components of an exemplary hearing aid are shown in FIG. 1. A microphone or other input transducer 110 receives sound waves from the environment and converts the sound into an input signal. After amplification by pre-amplifier 112, the input signal is sampled and digitized by A/D converter 114.

Other embodiments may incorporate an input transducer that produces a digital output directly. The device's signal processing circuitry 100 processes the digitized input signal into an output signal in a manner that compensates for the patient's hearing deficit. The output signal is then passed to an audio amplifier 150 that drives an output transducer 160 for converting the output signal into an audio output, such as a speaker within an earphone.

In the example illustrated in FIG. 1, the signal processing circuitry 100 includes a programmable controller made up of a processor 140 and associated memory 142 for storing executable code and data. The overall operation of the device is determined by the programming of the controller, which programming may be modified via a communication interface 144. The communication interface 210 allows input of data to a parameter modifying area of the memory 142 so that parameters affecting device operation may be changed. The communication interface 144 may provide interaction with a variety of devices for configuring the hearing aid such as industry standard programmers, wireless devices, mobile phones, or belt-worn appliances.

The signal processing modules 120, 130, and 135 may represent specific code executed by the controller or may represent additional hardware components. The filtering and amplifying module 120 amplifies the input signal in a frequency specific manner as defined by one or more signal processing parameters specified by the controller. As described above, the patient's hearing deficit is compensated by selectively amplifying those frequencies at which the patient has a below normal hearing threshold. Other signal processing functions may also be performed in particular embodiments. The example illustrated in FIG. 1, for example, also includes a gain control module 130 and a noise reduction module 135. The gain control module 130 dynamically adjusts the amplification in accordance with the amplitude of the input signal. Compression, for example, is a form of automatic gain control that decreases the gain of the filtering and amplifying circuit to prevent signal distortion at high input signal levels and improves the clarity of sound perceived by the patient. Other gain control circuits may perform other functions such as controlling gain in a frequency specific manner. The noise reduction module 135 performs functions such as suppression of ambient background noise and feedback cancellation.

The signal processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

The programmable controller specifies one or more signal processing parameters to the filtering and amplifying module and/or other signal processing modules that determine the manner in which the input signal is converted into the output signal. The one or more signal processing parameters that define a particular mode of operation are referred to herein as a signal processing parameter set. A signal processing parameter set thus defines at least one operative characteristic of the hearing aid's signal processing circuit. A particular signal processing parameter set may, for example, define the frequency response of the filtering and amplifying circuit and define the manner in which amplification is performed by the device. In a hearing aid with more sophisticated signal processing capabilities, such as for noise reduction or processing multi-channel inputs, the parameter set may also define the manner in which those functions are performed.

As noted above, a hearing aid programmed with a parameter set that provides optimal compensation may not be initially well tolerated by the patient. In order to provide for a gradual adjustment period, the controller is programmed to select a parameter set from a group of such sets in a defined sequence such that the hearing aid progressively adjusts from a sub-optimal to an optimal level of compensation delivered to the patient. In order to define the group of parameter sets, the patient is tested to determine an optimal signal processing parameter set that compensates for the patient's hearing deficit. From that information, a sub-optimal parameter set that is initially more comfortable for the patient can also determined, as can a group of such sets that gradually increase the degree of compensation.

The controller of the hearing aid may then be programmed to select a signal processing parameter set for use by the signal processing circuitry by sequencing through the group of signal processing parameter sets over time so that the patient's hearing is gradually compensated at increasingly optimal levels until the optimal signal processing parameter set is reached. For example, each parameter set may include one or more frequency response parameters that define the amplification gain of the signal processing circuit at a particular frequency. The controller of the hearing aid may be configured to transition between the group of signal processing parameters in response to receiving a specific command from a remote device via a communication interface, or in response to receiving time date from the remote device via the communication interface. For example, the specific command may indicate that the wearer of the hearing aid has entered a noisy environment (e.g., a loud restaurant) and a signal processing parameter with a higher level of noise reduction should be implemented by the controller.

In an example, the overall gain of the hearing aid may be gradually increased with each successively selected signal processing parameter set. If the patient has a high frequency hearing deficit, the group of parameter sets may be defined so that sequencing through them results in a gradual increase in the high frequency gain of the hearing aid. Conversely, if the patient has a low frequency hearing deficit, the hearing aid may be programmed to gradually increase the low frequency gain with each successively selected parameter set. In this manner, the patient is allowed to adapt to the previously unheard sounds through the automatic operation of the hearing aid. Other features implemented by the hearing aid in delivering optimal compensation may also be automatically adjusted toward the optimal level with successively selected parameter sets such as compression parameters that define the amplification gain of the signal processing circuit at a particular input signal level, parameters defining frequency specific compression, noise reduction parameters, and parameters related to multi-channel processing.

Figure 2:
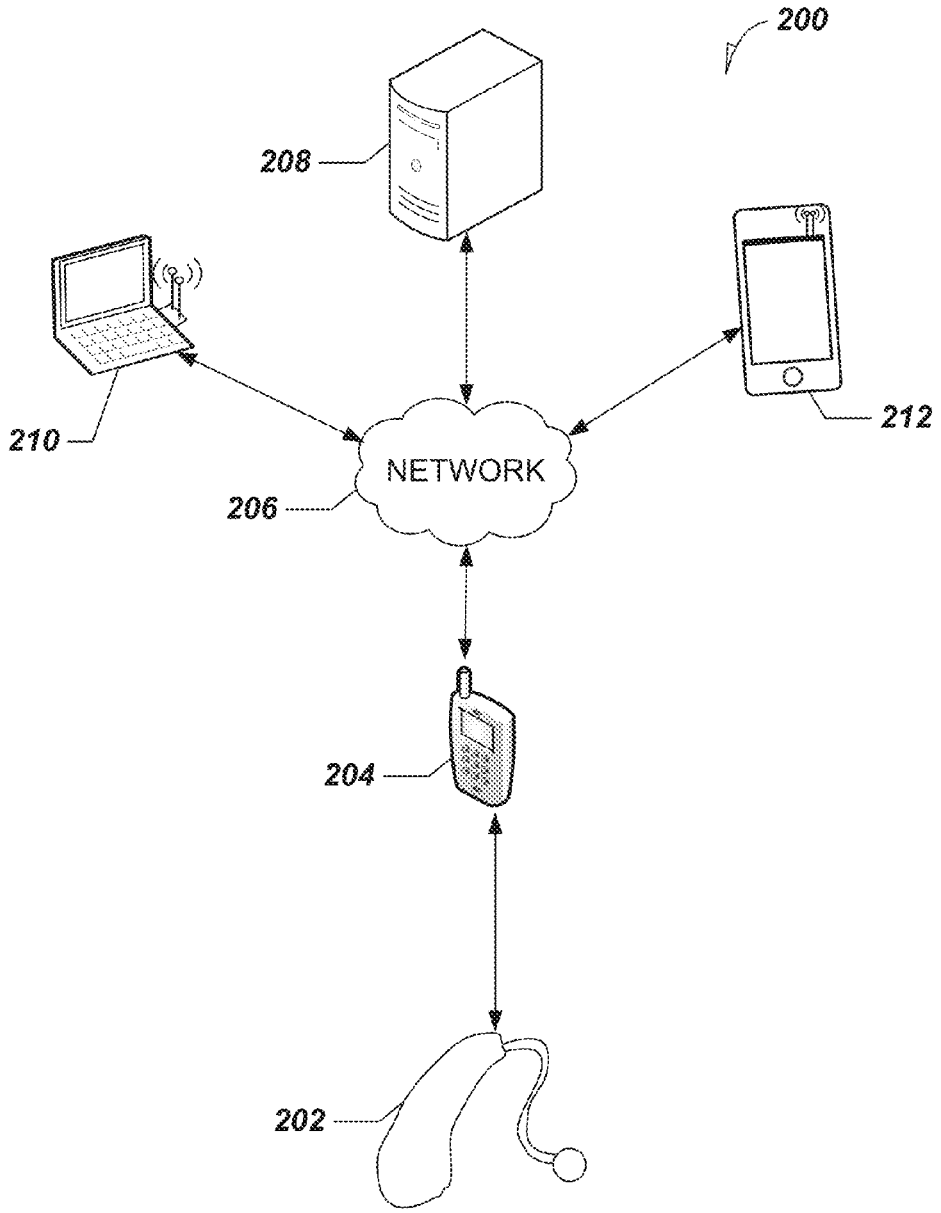
FIG. 2 is a block diagram illustrating an example of a signal processing system for use in a hearing assistance system.

FIG. 2 is a block diagram illustrating an example of a signal processing system 200 for use in a hearing assistance system. System 200 includes a hearing aid device 202, for example the device depicted in FIG. 1, a mobile device 204, such as a smart phone or personal data assistant. The mobile device 204 may be configured to communicate via a network 206, such as a cellular telephone network or the Internet, with a remote device 208. The remote device 208 may include a server, or any other computing device. Additionally, a personal computer 210, a mobile device 212, a tablet computer, or any other computing device having a user interface may communicate with the hearing aid device 202 or the mobile device 204 via the network 206.

For example, a care provider may be able to receive a notification if a patient wearing the hearing aid device 202 has not turned the hearing aid on during a specified period of time. The notification may be generated by an application on the mobile device 204 in response to a failure to communicate with the hearing aid device 202 for a predetermined number of hours or days. In another example, a hearing professional may interact with the personal computer 210 to request data from the hearing aid device 202 in response to a query or complaint by the wearer of the hearing aid device 202. An application on the mobile device 204 may retrieve from the hearing aid device 202, or an internal memory in the mobile device 204, any data corresponding to the performance of the hearing aid device 202 or configuration settings that have been in use by the hearing aid device 202.

Figure 3:
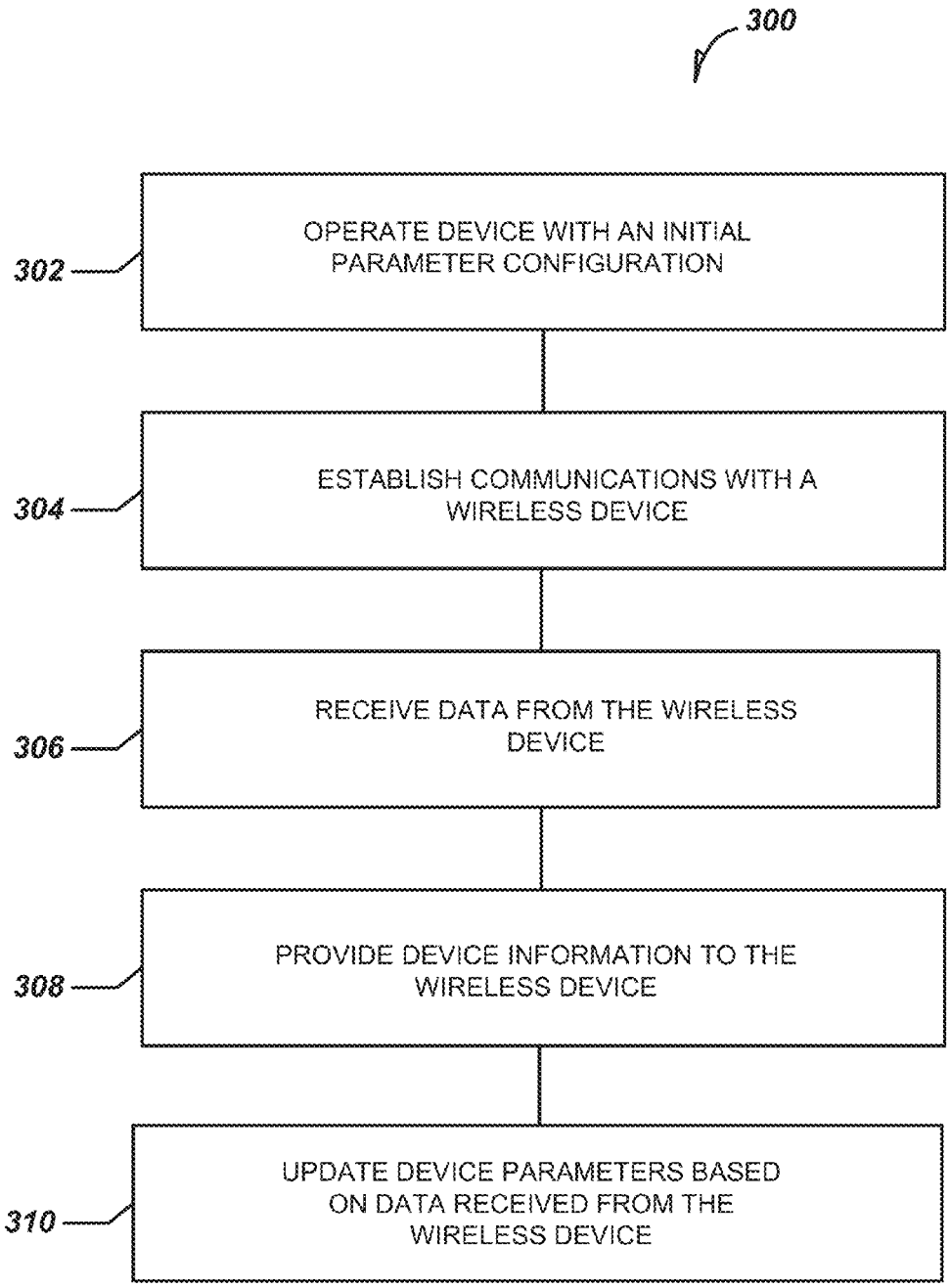
FIG. 3 is a flow chart illustrating an example of a method for hearing assistance device communication and programming.

FIG. 3 is a flow chart illustrating an example of a method 300 for hearing assistance device communication and programming. The method 300 may be performed by a hearing aid device such as the hearing aid device 202 depicted in FIG. 2 or the exemplary hearing aid of FIG. 1.

At 302, a device may operate with an initial parameter configuration. For example, a hearing aid device may be configured with an initial factory setting that provides a minimum of sound amplification and maximum noise reduction, or a hearing professional may establish a set of initial parameters based on one or more tests performed on a specific patient that will be fitted with the device.

At 304, the device may establish communication with a wireless device. The wireless device may be a mobile device, such as a smart phone or personal data assistant, as depicted in FIG. 2. The communications may be established according to any appropriate wireless communication protocol (e.g., Bluetooth, or one of the Institute of Electrical and Electronics Engineers (IEEE) 802.11 standards).

At 306, the device may receive data from the wireless device. The data may include, for example, configuration parameters, time data, sensor data, or any other information that be utilized by the device to change or improve the operation of the device.

At 308, the device may provide device information to the wireless device. The device information may include, for example: total operating time, batter life, current configuration settings, a count of power cycles, an amount of elapsed time since power-on, or any other device specific data.

At 308, the device may update the device's configuration (e.g., parameters, software, firmware, etc.) based on the data received from the wireless device. For example, the data may include an upgrade to firmware in the device, new configuration settings, or time data that may trigger the device to transition from a first set of parameters to a second set of parameters.

Though arranged serially in the example of FIG. 3, other examples may reorder the operations, omit one or more operations, and/or execute two or more operations in parallel using multiple processors or a single processor organized as two or more virtual machines or sub-processors. Moreover, still other examples may implement the operations as one or more specific interconnected hardware or integrated circuit modules with related control and data signals communicated between and through the modules. Thus, any process flow is applicable to software, firmware, hardware, and hybrid implementations.

Figure 4:
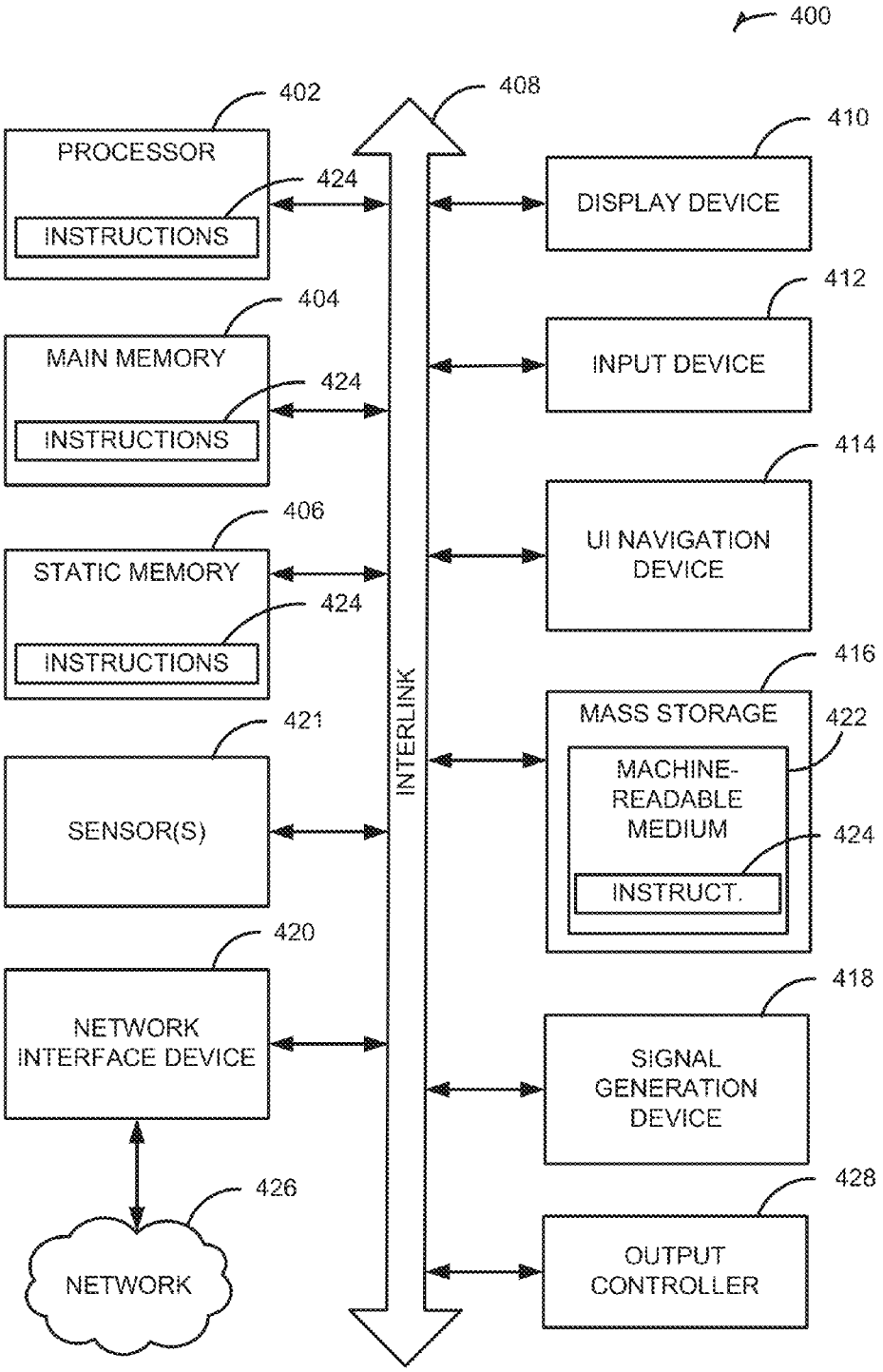
FIG. 4 is a block diagram illustrating an example of a controller of the signal processing system.

FIG. 4 is a block diagram illustrating an example machine 400 upon which any one or more of the techniques (e.g., methodologies) discussed herein may be performed. In alternative embodiments, the machine 400 may operate as a standalone device or may be connected (e.g., networked) to other machines. In a networked deployment, the machine 400 may operate in the capacity of a server machine, a client machine, or both in server-client network environments. In an example, the machine 400 may act as a peer machine in peer-to-peer (P2P) (or other distributed) network environments. The machine 400 may be a personal computer (PC), a tablet PC, a Personal Digital Assistant (PDA), a mobile telephone, a web appliance, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside (1) on a non-transitory machine-readable medium or (2) in a transmission signal. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 400 may include a hardware processor 402 (e.g., a processing unit, a graphics processing unit (GPU), a hardware processor core, or any combination thereof), a main memory 404, and a static memory 406, some or all of which may communicate with each other via a link 408 (e.g., a bus, link, interconnect, or the like). The machine 400 may further include a display device 410, an input device 412 (e.g., a keyboard), and a user interface (UI) navigation device 414 (e.g., a mouse). In an example, the display device 410, input device 412, and UI navigation device 414 may be a touch screen display. The machine 400 may additionally include a mass storage (e.g., drive unit) 416, a signal generation device 418 (e.g., a speaker), a network interface device 420, and one or more sensors 421, such as a global positioning system (GPS) sensor, camera, video recorder, compass, accelerometer, or other sensor. The machine 400 may include an output controller 428, such as a serial (e.g., universal serial bus (USB), parallel, or other wired or wireless (e.g., infrared (IR)) connection to communicate or control one or more peripheral devices (e.g., a printer, card reader, etc.).

The mass storage 416 may include a machine-readable medium 422 on which is stored one or more sets of data structures or instructions 424 (e.g., software) embodying or utilized by any one or more of the techniques or functions described herein. The instructions 424 may also reside, completely or at least partially, within the main memory 404, within static memory 406, or within the hardware processor 402 during execution thereof by the machine 400. In an example, one or any combination of the hardware processor 402, the main memory 404, the static memory 406, or the mass storage 416 may constitute machine readable media.

While the machine-readable medium 422 is illustrated as a single medium, the term "machine readable medium" may include a single medium or multiple media (e.g., a centralized or distributed database, and/or associated caches and servers) that configured to store the one or more instructions 424.

The term "machine-readable medium" may include any tangible medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 424 may further be transmitted or received over a communications network 426 using a transmission medium via the network interface device 420 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), peer-to-peer (P2P) networks, among others. In an example, the network interface device 420 may include one or more physical jacks (e.g., Ethernet, coaxial, or phone jacks) or one or more antennas to connect to the communications network 426. In an example, the network interface device 420 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 400, and includes digital or analog communications signals or other intangible medium to facilitate communication of such software.

Various embodiments of the present subject matter may be utilized in conjunction with a hearing assistance device that supports wireless communications from other devices. It is further understood that many hearing assistance devices may be used without departing from the scope of the present subject matter and that the devices depicted in the figures are intended to demonstrate the subject matter, but not in a limited, exhaustive, or exclusive sense. It is also understood that the present subject matter can be used with a device designed for use in the right ear or the left ear or both ears of the wearer.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. It is understood that other hearing assistance devices not expressly stated herein may be used in conjunction with the present subject matter.

It is understood that digital hearing aids referenced in this patent application include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

In various embodiments the hearing assistance device may include additional electronics, such as wireless communications electronics that can include support standard or non-standard communications. Some examples of standard wireless communications include link protocols including, but not limited to, Bluetooth™, IEEE 802.11(wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. In various embodiments it is possible that other forms of wireless communications can be used such as ultrasonic, optical, and others.

Various configurations of wireless electronics and antennas may be employed. It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. Thus, the examples set forth herein are intended to be demonstrative and not a limiting or exhaustive depiction of variations.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system for delivering sounds to a listener, comprising: a signal processor configured to process an input sound signal and produce an output sound signal to be delivered to the listener by executing a signal processing algorithm using values included in a plurality of parameters; a wireless communication module; and a controller configured to:

receive an initial set of values for the plurality of parameters; communicate with a wireless device via the wireless communication module; receive a data value from the wireless device; and update at least one of the plurality of parameters in response to receiving the data value from the wireless device; wherein the wireless device comprises: a user interface, a network communication module configured to communicate with the wireless communication module, and a processor configured to select a signal processing parameter set for operation of the signal processor from a group of parameter sets and sequence through the group of parameter sets.

2. The hearing assistance system of claim 1, comprising a hearing aid including the signal processor, the wireless communication module, and the controller.

3. The hearing assistance system of claim 1, wherein the group of parameter sets relate to gradually varying hearing compensation.

4. The hearing assistance system of claim 1, wherein the user interface comprises a touchscreen configured to display the user interface, and the final parameter set is designed to optimally compensate for a particular patient's hearing deficit.

5. The hearing assistance system of claim 1, wherein the wireless device is a smartphone.

6. The hearing assistance system of claim 1, wherein the wireless device comprises a tablet computer.

7. The hearing assistance system of claim 1, wherein the network communication module is configured to communicate with the wireless communication module and a wireless network.

8. The hearing assistance system of claim 7, wherein the network communication module configured to communicate the data value to a server over the wireless network.

9. The hearing assistance system of claim 1, wherein the wireless device comprises a real time clock, and the processor is configured to sequence through the group of parameter sets over time in accordance with real time events received from the real time clock.

10. A method for delivering sounds to a listener, the method comprising: processing, by a signal processor, an input sound signal; producing, by the signal processor an output sound signal to be delivered to the listener by executing a signal processing algorithm using values included in a plurality of parameters; receiving, by a controller coupled to the signal processor, an initial set of values for the plurality of parameters; communicating with a wireless device via a wireless communication module coupled to the controller; receiving a data value from the wireless device; and updating at least one of the plurality of parameters in response to receiving the data value from the wireless device; wherein the wireless device comprises: a user interface, a network communication module configured to communicate with the wireless communication module, and a processor configured to select a signal processing parameter set for operation of the signal processor from a group of parameter sets and sequence through the group of parameter sets.

11. The method of claim 10, comprising a hearing aid including the signal processor, the wireless communication module, and the controller.

12. The method of claim 10, wherein the group of parameter sets relate to gradually varying hearing compensation.

13. The method of claim 10, wherein the user interface comprises a touchscreen configured to display the user interface, and the final parameter set is designed to optimally compensate for a particular listener's hearing deficit.

14. The method of claim 10, wherein the wireless device is a smartphone.

15. The method of claim 10, wherein the wireless device comprises a tablet computer.

16. The method of claim 10, wherein the network communication module is configured to communicate with the wireless communication module and a wireless network.

17. The method of claim 16, wherein the network communication module configured to communicate the data value to a server over the wireless network.

18. The method of claim 10, wherein the wireless device comprises a real time clock, and the processor is configured to sequence through the group of parameter sets over time in accordance with real time events received from the real time clock.

* * * * *

UNITED STATES PATENT AND TRADEMARK OFFICE

CERTIFICATE OF CORRECTION

PATENT NO. : 8,965,016 B1
APPLICATION NO. : 13/958212
DATED : February 24, 2015
INVENTOR(S) : Christopher Larry Howes It is certified that error appears in the above-identified patent and that said Letters Patent is hereby corrected as shown below:

On the Title page, in item (22), in "Filed", in column 1, line 1, after "Aug. 2, 2013", insert --(65) Prior Publication Data ¶US 2015 0036851 A1 Feb. 05, 2015--, therefor On the Title page, item (56), under "Other Publications", in column 2, line 1, delete "27," and insert --26,--, therefor Signed and Sealed this
Twenty-first Day of July, 2015

Michelle K. Lee

Michelle K. Lee
*Director of the United States Patent and Trademark Office*